United States Patent [19]

Wagatsuma

[11] 4,121,477

[45] Oct. 24, 1978

[54] INDEXING MECHANISM

[75] Inventor: Tadashi Wagatsuma, Furukawa, Japan

[73] Assignee: Alps Electric Co., Ltd., Japan

[21] Appl. No.: 765,541

[22] Filed: Feb. 4, 1977

[30] Foreign Application Priority Data

Feb. 9, 1976 [JP] Japan ..... 51-13749[U]

[51] Int. Cl.$^2$ ..... G05G 5/06

[52] U.S. Cl. ..... 74/527

[58] Field of Search ..... 74/527

[56] References Cited

U.S. PATENT DOCUMENTS

| | | | |
|---|---|---|---|
| 2,771,547 | 11/1956 | Bell et al. | 74/527 X |
| 2,778,229 | 1/1957 | Simpson et al. | 74/527 |
| 3,059,498 | 10/1962 | Boyd | 74/527 |

*Primary Examiner*—Donald R. Schran

*Attorney, Agent, or Firm*—Guy W. Shoup; Gerard F. Dunne

[57] ABSTRACT

A rotatable and axially movable detent disc is formed with a periphery having a triangular cross section. The sides of the triangular cross section are formed with circumferentially spaced triangular detent grooves. A detent member is resiliently urged against the periphery of the disc for yieldable detent disc holding engagement in the detent grooves. The grooves provide a plurality of rotational detent positions corresponding to the number of grooves and the apex of the triangular cross section of the periphery of the disc provides two axial detent positions with the apex on either side of the detent member respectively.

5 Claims, 6 Drawing Figures

11
17b
17a
22
12

21
16b
19
18
17
13
31
14
16
18
16a
21
23
19

22
31

11
23
26
29
13a
28a
28
17
17b
17a
16b
12
14
16a
24
27
28a
13

22
23
31
11
13a
29
28
28a
17b
14
12
17
16b
16a
16
17a
24
27
13

INDEXING MECHANISM

BACKGROUND OF THE INVENTION

The present invention relates to a combination rotary and axial detent mechanism for a switch assembly or the like.

Although various detent mechanisms have been known heretofore, a simple, reliable, inexpensive detent mechanism which provides at least two rotational detent positions and at least two axial detent positions which will yieldably hold, for example, a switch shaft in any selected rotational and axial position, has not appeared in the prior art.

SUMMARY OF THE INVENTION

In one form of the invention a detent disc is rotationally and axially movable in an integral relationship with a shaft for a switch or the like. The periphery of the detent disc is formed with a triangular cross section with the apex of the cross section constituting a circumferential ridge. The sides of the periphery of the detent disc defining the triangular cross section are formed with detent recesses which are preferably triangular grooves. A detent member such as a spring loaded ball is urged against the periphery of the detent disc for yieldable detent disc holding engagement in the grooves. The grooves provide a plurality of rotational detent positions corresponding to the number of the grooves and the apex of the cross section of the detent disc provides two axial detent positions with the apex on either side of the ball respectively. In another form of the invention the periphery of the detent disc is formed with two or more ridges providing three of more axial detent positions respectively.

It is an object of the present invention to provide a simple, reliable and inexpensive detent mechanism which provides at least two rotational detent positions and at least two axial detent positions.

It is another object of the present invention to provide a combination rotary and axial detent mechanism which may be advantageously incorporated into a large number of mechanical and electromechanical devices.

It is another object of the present invention to provide a combination rotary and axial detent mechanism which may be particularly incorporated into a television tuner.

It is another object of the present invention to provide a generally improved combination rotary and axial detent mechanism.

Other objects, together with the foregoing, are attained in the embodiments described in the following description and illustrated in the accompanying drawing.

DESCRIPTION OF THE PREFERRED EMBODIMENTS

Figure 1:
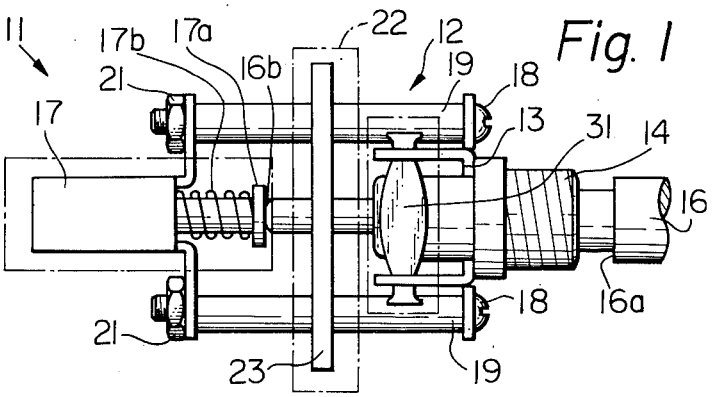
FIG. 1 is a top plan view of a combination rotary and axial detent mechanism embodying the present invention.

While the combination rotary and axial detent mechanism of the invention is susceptible of numerous physical embodiments, depending upon the environment and requirements of use, substantial numbers of the herein shown and described embodiments have been made, tested and used, and all have performed in an eminently satisfactory manner.

Referring now to FIGS. 1 to 5 of the drawing, a television tuner switch 11 comprises a detent mechanism embodying the present invention which is generally designated by the reference numeral 12. The switch 11 comprises a bracket 13 to which is secured a threaded bushing 14. The switch 11 may be mounted to a television receiver by means of a nut (not shown) screwed onto the bushing 14 with a structural member of the television receiver between the bracket 13 and nut. An operating shaft 16 is rotatably and axially slidably supported by the bushing 14 and is formed with a shoulder **16*a* which abuts against the right end of the bushing 14 in the position of FIG. 3. The left end 16*b* engages with an actuator 17*a* of a changeover switch 17. A compression spring 17*b* urges the actuator 17*a* to engage with the end 16*b* of the shaft 16 at all times. The changeover switch 17 is attached to the bracket 13 by means of bolts 18, spacers 19 and nuts 21**.

A channel selector switch 22 is also secured to the frame 13 by the same means as the switch 17 and comprises a wafer 23 provided with a plurality of fixed contacts 24, only one contact 24 being shown and labeled. A rotor 26 is provided with a plurality of movable contacts 27, again only one contact 27 being shown and labeled, which are adapted to ohmically engage with the contacts 24 in a prearranged manner at the various positions of the rotor 26. The rotor 26 is rotatably supported by the wafer 23 and is splined or similarly connected to the shaft 16 so that the shaft 16 is axially slidable through the rotor 26 but the rotor 26 is connected to the shaft 16 for unitary rotation.

Figure 3:
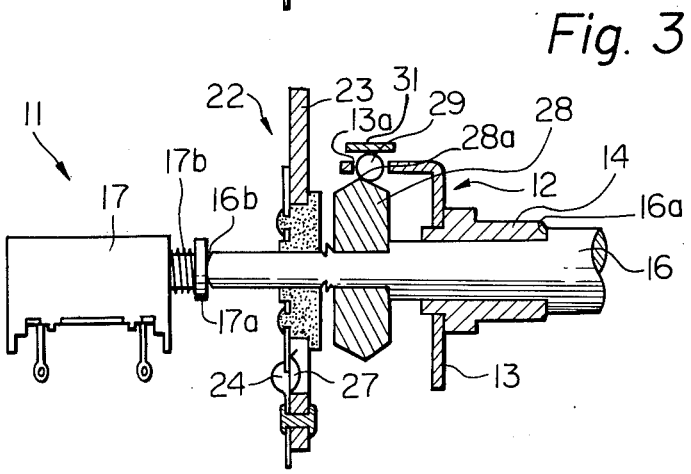
FIG. 3 is similar to FIG. 2 but shows the detent disc in a second stable detent position.
Figure 4:
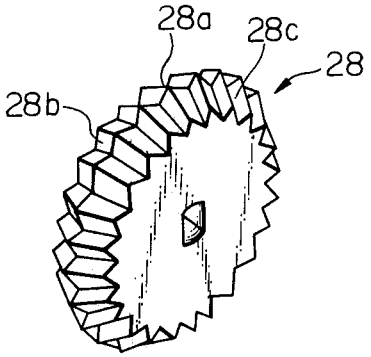
FIG. 4 is a perspective view of the detent disc.
Figure 5:
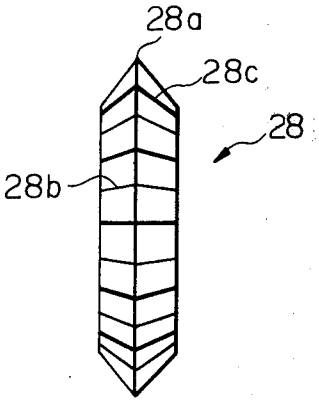
FIG. 5 is an elevational view of the detent disc.

Fixedly mounted on the shaft 16 is a detent wheel or disc 28, preferably made of plastic, which is best seen in FIGS. 4 and 5. As shown in the cross sectional view of FIGS. 2 and 3, the circumference or periphery of the detent disc 28 is triangular in shape with the apex of the triangular cross section defining a circumferential ridge **28*a*. A plurality of triangular recesses or grooves 28*b*, only one groove 28*b* being labeled for simplicity of illustration, are formed in the left side of the periphery of the detent disc 28 as viewed in the drawing. In an essentially similar manner, a plurality of identical circumferentially spaced grooves 28*c* are formed in the right side of the periphery of the detent disc 28. In the particular form shown in the drawing, the grooves 28*b* and 28*c* are provided in the same number with respective grooves 28*b* and 28*c* meeting at the ridge 28*a*. The grooves 28*b* and 28*c* may be considered as constituting continuous grooves which extend through the ridge 28*a*. However, the grooves 28*b* and 28*c*** may be replaced by, for example, circular recesses, and provided in different numbers.

The bracket 13 is bent in its upper portion as shown and formed with a circular hole **13*a*. A ball 29 which constitutes a detent member is retained in the hole 13*a* so as to be prevented from any movement except toward and away from the detent disc 28. The bracket 13 is also formed so as to retain a leaf spring 31 which constantly presses the ball 29 against the periphery of the detent disc 28**.

Although the tuner switch 11 may be provided in many forms, in the exemplary case shown the changeover switch 17 may be used to switch between VHF and UHF operation. With the shaft 16 in the retracted position shown in FIG. 2 the changeover switch 17 adapts the channel selector switch 22 for VHF operation, and in the depressed position of FIG. 3 the changeover switch 17 adapts the channel selector switch 22 for UHF operation through translation of the actuator 17*a* by the shaft 16.

Figure 2:
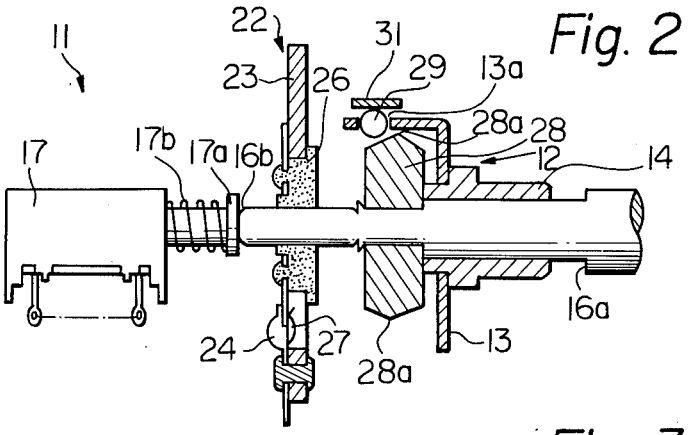
FIG. 2 is an elevational view, partially in section, of the detent mechanism with a detent disc thereof in a first axial detent position.

With the shaft 16 in the position of FIG. 2, the detent disc 28 abuts against the left side of the bushing 14 and the ball 29 engages in one of the grooves 28*b* in the left side of the periphery of the detent disc 28. Rotation of the shaft 16 and detent disc 28 will cause the ball 29 to engage in different grooves 28*b* as desired. The resilient force of the ball 29, engaged in one of the grooves 28*b*, prevents inadvertent rotation of the shaft 16, detent disc 28 and switch rotor 26. The various contacts 24 and 27 are arranged to align when the ball 29 is engaged in the respective grooves 28*b*, which correspond to the channel positions. Thus, the channel selector switch 22 is provided with a plurality of rotational detent positions. The spring 31 will yield only when the shaft 16 is rotated with sufficient force so that the television viewer may change channels.

It will be seen that the ball 29, in addition to yieldably preventing the detent disc 28 from rotation, also prevents the shaft 16 from being depressed unless the television viewer presses the shaft 16 inwardly with sufficient force to overcome the force of the spring 31. This is because the ridge 28*a* provides an axial detent function with two stable positions. The first stable position is shown in FIG. 2 in which the ball 29 engages in a groove 28*b* and the detent disc 28 abuts against the bushing 14. The second is shown in FIG. 3 in which the ball 29 engages in a groove 23*c* and the shoulder 16*a* of the shaft 16 abuts against the bushing 14.

In the position of FIG. 3 for VHF viewing, the shaft 16 may be rotated so that the ball 29 engages in a selected groove 28*c* for UHF channel selection. The particular configuration shown is especially advantageous since the respective grooves 28*b* and 28*c* meet at the ridge 28*a* and the shaft 16 is prevented from inadvertent rotation when the shaft 16 is pulled or pushed.

Figure 6:
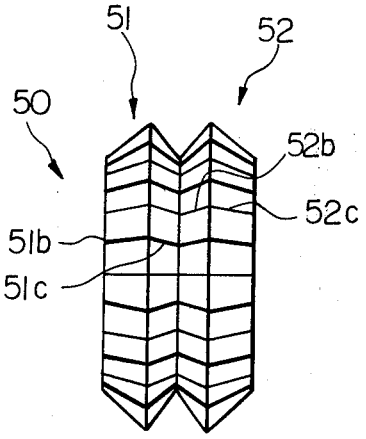
FIG. 6 is similar to FIG. 5 but shows another embodiment of the detent disc.

Another embodiment of the detent disc 28 is shown in FIG. 6 and designated as 50. The detent disc 50 provides three axial detent positions instead of just two and may be considered as two detent discs 28 joined together. The detent disc 50 comprises a left section 51 and a right section 52, each of the left and right sections 51 and 52 respectively having a periphery with a triangular cross section. The apex of the periphery of the left section 51 defines a ridge 51*a*. Triangular grooves 51*b* and 51*c* are formed to the left and right of the ridge 51*a* respectively. In an essentially similar manner, the section 52 has a ridge 52*a* and grooves 52*b* and 52*c* formed on the left and right sides of the ridge 52*a* respectively.

The three axial detent positions of the detent disc 50 are with the ball 29 to the left of the ridge 51*a*, between the ridges 51*a* and 52*a* and to the right of the ridge 52*a* respectively.

In summary, it will be seen that present invention provides a simple, reliable and economical detent mechanism which provides at least two stable positions in both rotation and translation, which can be incorporated into a number of devices in addition to the television tuner switch shown and described. Many modifications will become possible for those skilled in the art after receiving the teachings of the present disclosure without departing from the scope thereof.

What is claimed is:

1. A detent mechanism comprising:

a detent disc adapted to be mounted to a shaft movable rotatably and axially, said detent disc having a ridge extending circumferentially about the periphery of said detent disc, a plurality of first detent recesses spaced circumferentially about the periphery of said detent disc and located on one side of said ridge, and a plurality of second detent recesses spaced circumferentially about the periphery of said detent disc and located on the other side of said ridge; and a detent member resiliently urged against the periphery of said detent disc for yieldable engagement in a selected detent recess, whereby said detent disc can hold the shaft in both a rotatable and axial position selected.

2. A detent mechanism as in claim 1, in which respective first and second detent recesses meet at the ridge.

3. A detent mechanism as in claim 1, in which the periphery of the detent disc has a triangular cross section, the ridge constituting an apex of the triangular cross section.

4. A detent mechanism as in claim 3, in which the first and second detent recesses are formed as triangular grooves in respective sides of the periphery of the detent disc defining the triangular cross section.

5. A detent mechanism as in claim 1, in which the detent member comprises a ball, the mechanism further comprising a ball retainer for retaining the ball and a spring urging the ball against the periphery of the detent disc.

* * * * *